US005720137A

United States Patent [19]

Rodriquez

[11] Patent Number: 5,720,137

[45] Date of Patent: Feb. 24, 1998

[54] WINDOW DRAFT SHIELD

[76] Inventor: Richard Rodriquez, 4129 Amber Ln., Weston, Fla. 33331

[21] Appl. No.: 771,532

[22] Filed: Dec. 23, 1996

[51] Int. Cl.[6] ..... E06B 3/26

[52] U.S. Cl. ..... 52/202; 160/98; 160/269

[58] Field of Search ..... 52/202; 160/98, 160/269, 23.1, 273.1

[56] References Cited

U.S. PATENT DOCUMENTS

| | | | |
|---|---|---|---|
| 4,122,886 | 10/1978 | Marangoni | 160/269 |
| 4,261,410 | 4/1981 | Standiford | 160/269 |
| 4,335,552 | 6/1982 | Blanchett et al. | 52/202 |
| 4,407,349 | 10/1983 | Ekstrom | 160/98 |
| 4,453,585 | 6/1984 | Ruggeberg et al. | 52/202 X |
| 5,067,540 | 11/1991 | Besler | 160/31 |
| 5,249,616 | 10/1993 | Yen | 160/98 |

OTHER PUBLICATIONS

Copending U.S. Patent Application Ser. No. 08/594,753, filed Jan. 31, 1996, entitled "Window Draft Shield," by inventor Richard Rodriquez.

*Primary Examiner*—Creighton Smith

*Attorney, Agent, or Firm*—Harvey Lunenfeld

[57] ABSTRACT

A window draft shield having at least one flexible window for preventing draft from infiltrating into a building. The window draft shield has at least one roller, each of the rollers having at least one flexible window mounted thereon and for dispensing and retracting each of the respective flexible windows; an exterior frame for supporting the rollers, the exterior frame having a plurality of locking clamps for locking the flexible windows into place and creating a seal between the flexible windows and the exterior frame when the flexible windows are dispensed; and a plurality of mating interior support frames adjoined to the exterior frame and for adjoining the window draft shield to a window casing.

24 Claims, 6 Drawing Sheets

WINDOW DRAFT SHIELD

CROSS-REFERENCES

The present application is related to copending application Ser. No. 08/594,753, filed Jan. 31, 1996, entitled "Window Draft Shield," by inventor Richard Rodriguez, which is included herein by this reference and which is not admitted to be prior art with respect to the present invention.

BACKGROUND OF THE INVENTION

1. Field of the Invention

The present invention relates generally to combination windows and more particularly to draft protection windows.

2. Background Art

Draft from windows is a major cause of heating and cooling loss associated with homes, buildings, and structures of all kinds. Draft also aggravates internal environmental conditions and contributes to discomfort of individuals within such structures.

Eddy currents are created by an insufficiency in the thermal barrier between the outside and inside of such buildings, thereby creating, in most cases, unwanted drafts within the buildings. Rapid changes in thermal gradient in the vicinity of windows, which are generally less thermally protected than the rest of building, cause such eddy currents. Inserting a barrier of insulation as an interface between the window and either the interior or the exterior of the building will act to decrease extremely rapid changes in thermal gradient between the exterior and interior of the building. Eddy currents and associated drafts within the building in the vicinity of the windows will be decreased. Low density materials, such as air and transparent gasses generally make excellent thermal insulators.

There is a need for an inexpensive, attractive, easy to install window draft shield that prevents draft from infiltrating into a building, may be installed during window installation or as a retrofit to an existing window installation, inside or outside the window, fits irregularly shaped windows, and is adjustable in height and width to fit a variety of window sizes and irregularities in shape, and that is easy to use.

Different windows and combination windows have heretofore been known. However, none of the windows and combination windows adequately satisfies these aforementioned needs. Storm windows have been used as adjuncts to existing windows, in order to create thermal interfaces of air between the exteriors of existing windows and the outside environment. Such storm windows are generally expensive to install, usually fit only one size window, and do not adapt easily to irregularly shaped windows that may have distorted over time.

Windows with double glass and a layer of air or gas between each of the facing glass surfaces for improved thermal insulation have also been known. However, double glass windows with thermal insulation and windows retrofitted with storm windows have generally been expensive.

Leakage is also a problem with moveable double glass windows and combination windows that open and close, as a result of imperfect seals, which often allow air infiltration between interior and exterior environments.

A low cost alternative is also known, in which a flexible, transparent sheet is placed across the window, with a space between the window and the flexible, transparent sheet in which the sheet is taped to the window casing has been known. Although this alternative is inexpensive it is generally makeshift, considered to be unattractive, and does not allow windows to be opened and closed.

A low cost alternative to air infiltration at cracks, joints, and voids in which weather stripping in the form of tape is placed around the perimeters of windows to prevent leakage through these cracks and joints is also known. However, this approach does not thermally insulate the windows and only prevents air infiltration from these cracks, joints, and voids. Drafts from rapid thermal gradients at the window surfaces, owing to a lack of insulation still prevails. Furthermore, the weather stripping is unattractive and generally does not allow the windows to opened and closed.

Different window draft protectors have been disclosed.

U.S. Pat. No. 4,407,349 (Ekstrom) discloses an opaque foil shield for windows having at least two panes, a frame, and an air tight space between the panes. The shield is extendible and retractable out of and into a storing position between the panes, using a piston. A pressurized air conduit opens into the space on one side of the piston and a second conduit opens into the space on the other side of the piston. A valve is used to supply air to one of the conduits, while return air flows through the other conduit, so that the piston can be displaced in either an extended or retracted within the panes, and thereby unroll or roll the shield between the panes.

U.S. Pat. No. 4,122,886 (Marangoni) discloses a window shade edge holder, which is a continuous cord that is stretched tightly along the vertical outer edges of a window shade and across the top of the shade. Owing to the position of and the tension in the cord, the cord is able to force the shade against the frame of the window. The window shade edge holder is used as a tie-down system for holding the top and side edges of the shade to the top and sides of a window frame comprising a pair of brackets mounted to opposed upper corners of the window frame, a pair of clasps mounted to opposed lower corner of the frame for movement into and out of locking engagement with the clasps, and a flexible cord extending between the brackets and swing arms. The shade is used to reduce the amount of light and heat transfer through the window.

U.S. Pat. No. 4,261,410 (Standiford) discloses a self-adjusting, self-storing rollaway inside storm window for use with conventional windows, which includes a transparent flexible panel mounted on and constantly tensioned at the top end by a spring-retracting roller in the manner of a window shade and deployable over a self-adjusting spring biased extension rod. A special shock cord is deployed along each side of the panel between upper and lower self-adjusting spring loaded rods to bias vertical edges of the panel in a direction for sealing against the window frame structure.

U.S. Pat. No. 5,067,540 (Besler) describes a combination window frame with mounted roll-up shutter channels and associated shutter housing that addresses the need for simple and rapid on site assembly. A screwless connection between the shutter housing and the window frame saves time and personnel.

For the foregoing reasons, there is a need for an inexpensive, attractive, easy to install window draft shield that prevents draft from infiltrating into a building, may be installed during window installation or as a retrofit to an existing window installation, inside or outside the window, fits irregularly shaped windows that may have distorted over time, is durable, adjustable in height and width to fit a variety of window sizes and irregularities in shape, is easy to use, and allows windows to open and close.

SUMMARY

The present invention is directed to an inexpensive, attractive, easy to install window draft shield that prevents draft from infiltrating into a building, may be installed during window installation or as a retrofit to an existing window installation, inside or outside the window, fits irregularly shaped windows that may have distorted over time, is durable, adjustable in height and width to fit a variety of window sizes and irregularities in shape, is easy to use, and allows windows to open and close.

A window draft shield having features of the present invention comprises: at least one flexible window for preventing draft from infiltrating into a building; at least one roller, each of the rollers having at least one flexible window mounted thereon and for dispensing and retracting each of the respective flexible windows; an exterior frame for supporting the rollers, the exterior frame having a plurality of locking clamps for locking the flexible windows into place and creating a seal between the flexible windows and the exterior frame when the flexible windows are dispensed; and a plurality of mating interior support frames adjoined to the exterior frame and for adjoining the window draft shield to a window casing.

DRAWINGS

These and other features, aspects, and advantages of the present invention will become better understood with regard to the following description, appended claims, and accompanying drawings where:

DESCRIPTION

The preferred embodiments of the present invention will be described with reference to FIGS. 1–7 of the drawings. Identical elements in the various figures are identified with the same reference numbers.

Figure 1:
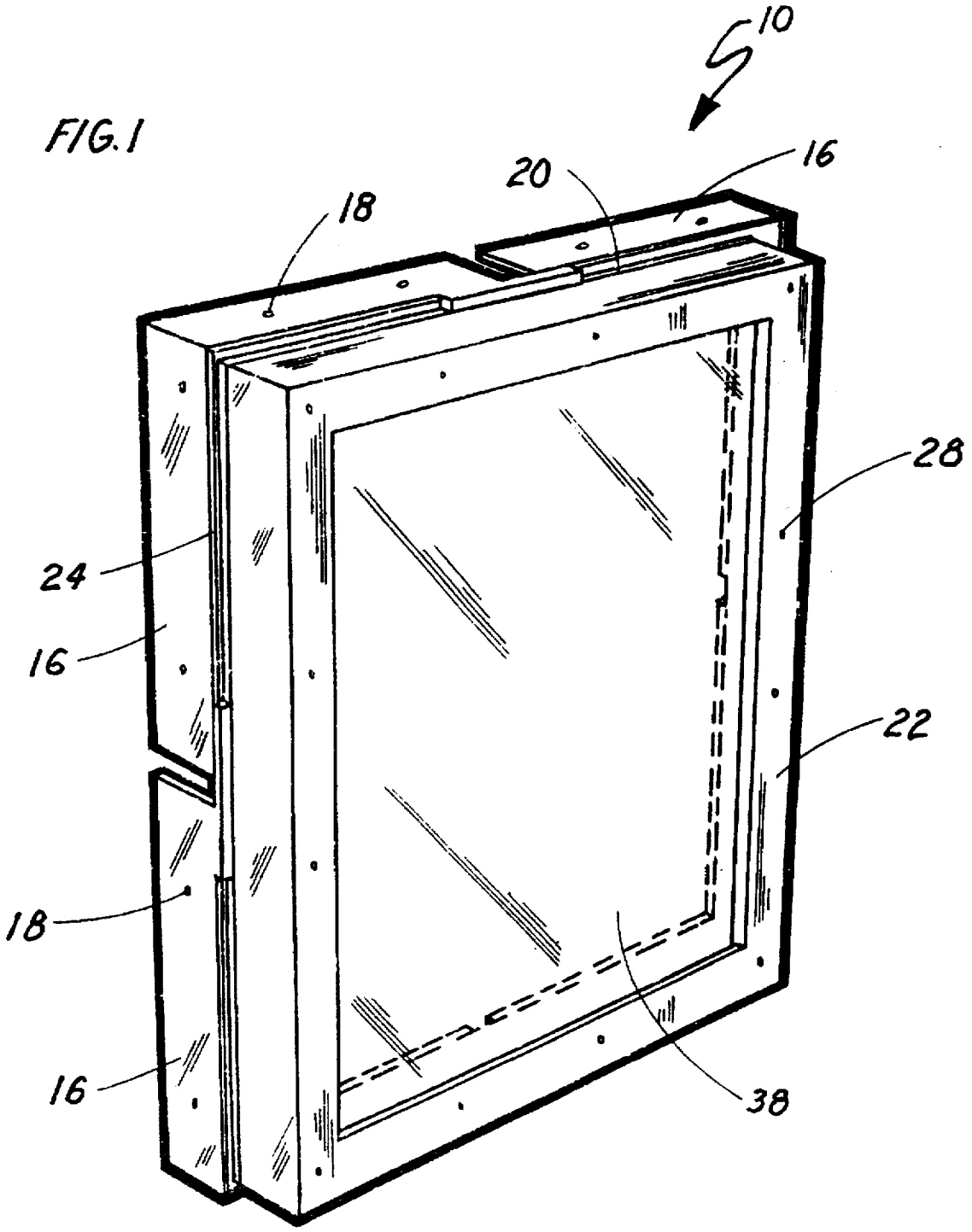
FIG. 1 is a perspective view of a window draft shield, constructed in accordance with the present invention.
Figure 2:
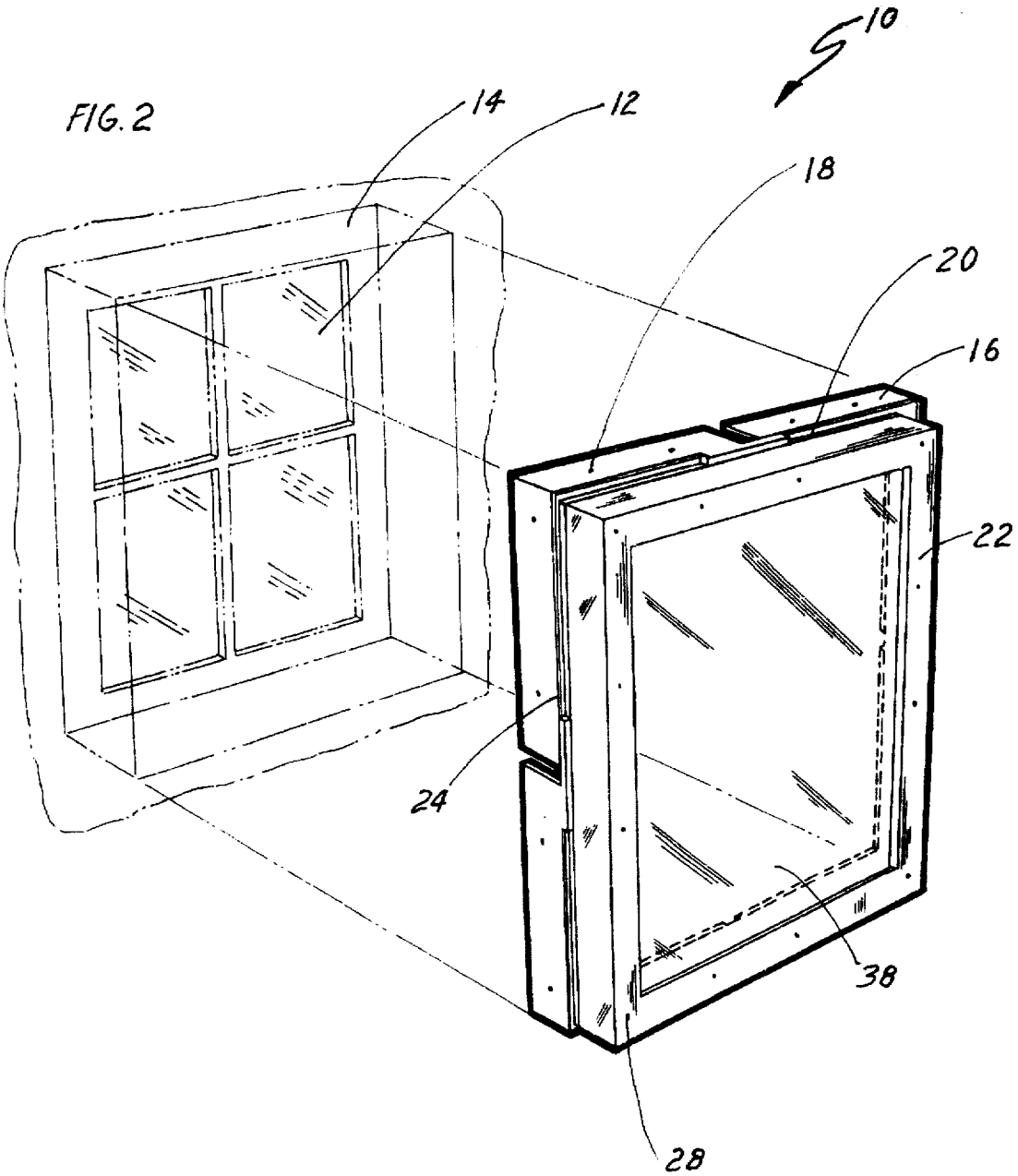
FIG. 2 is a perspective view of the window draft shield and a window casing prior to installation.
Figure 3:
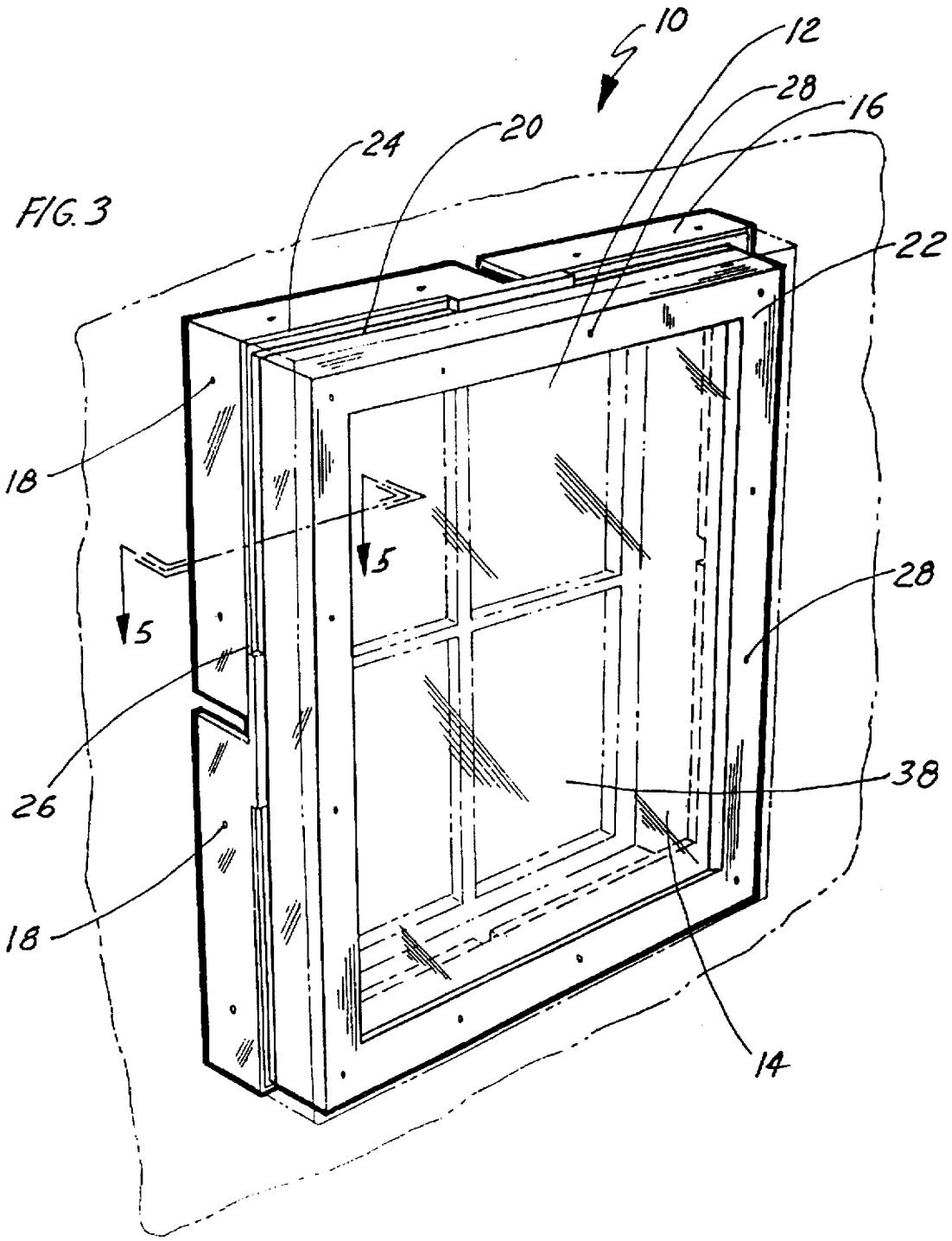
FIG. 3 is a perspective view of the window draft shield adjoined to the window casing.

FIG. 1 shows an embodiment of the present invention, a window draft shield 10, constructed in accordance with the present invention. FIG. 2 shows the window draft shield 10, prior to installation at a window 12 having a window casing 14; and FIG. 3 shows the window draft shield 10 adjoined to the window casing 14 after installation.

Figure 4:
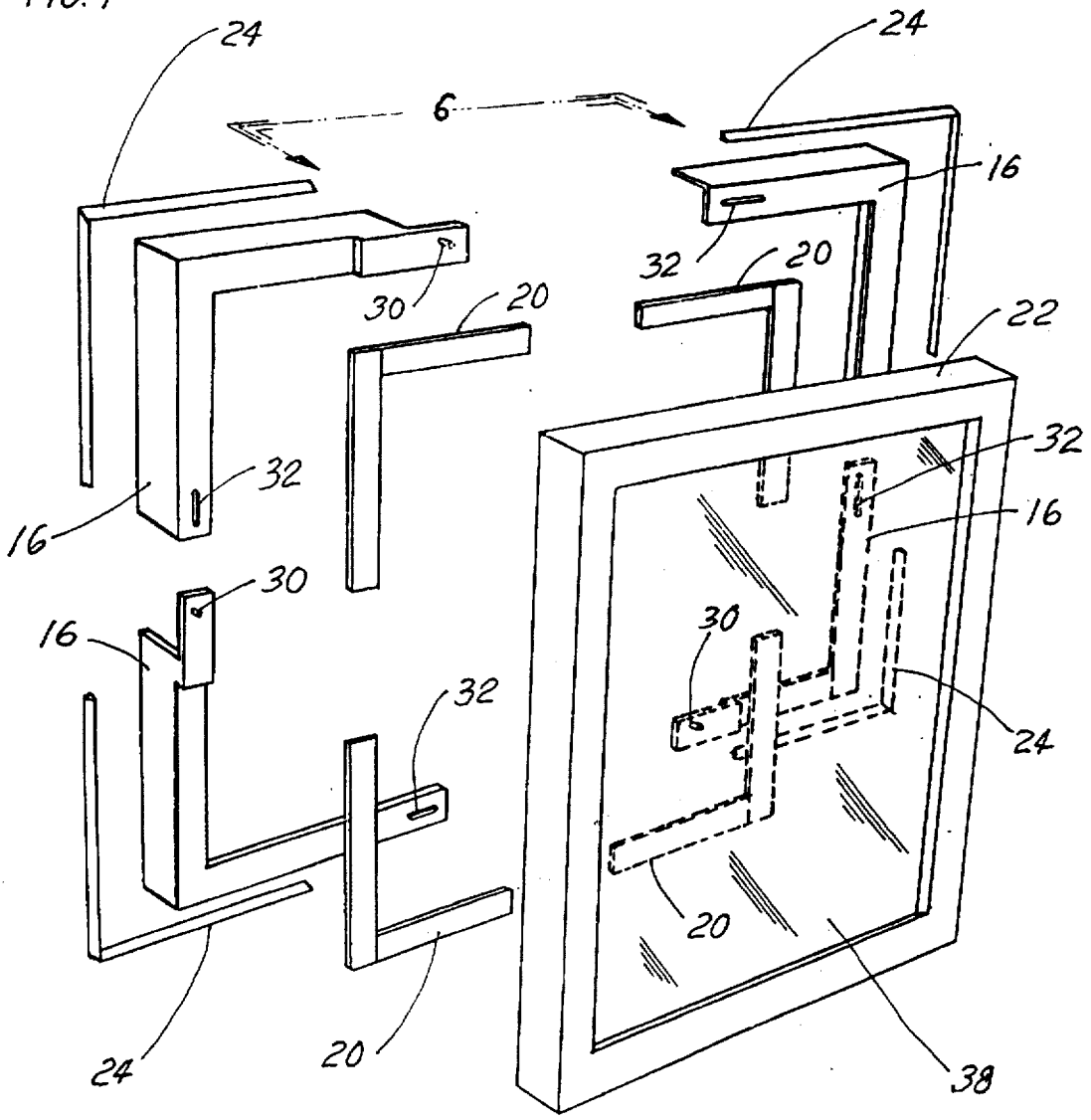
FIG. 4 is a perspective break out view of the window draft shield prior to assembly.
Figure 5:
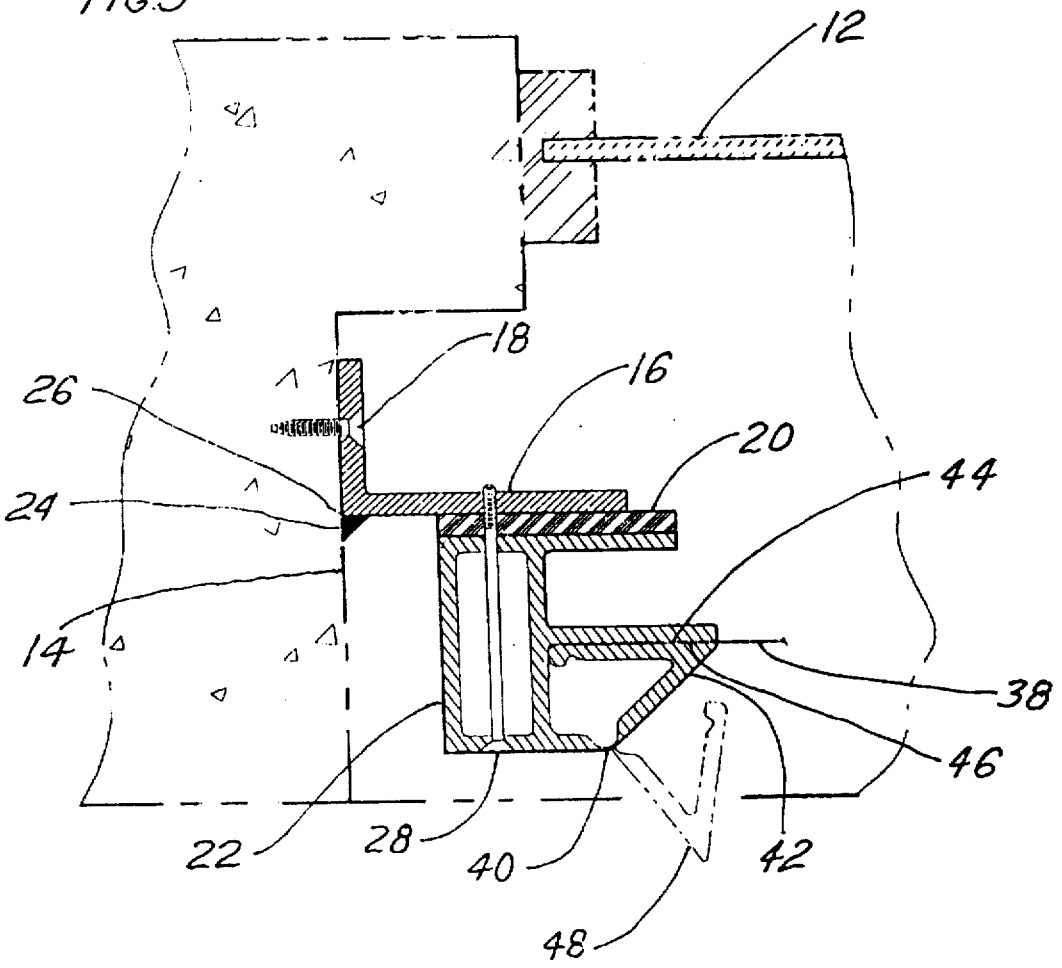
FIG. 5 is a cross sectional view of a vertical section of an exterior frame of the window draft shield.

The window draft shield 10, as shown in FIGS. 4 and 5, has mating interior support frames 16, which are mounted to the window casing 14 by screws 18. A seal 20 is sandwiched between the interior support frames 16 and exterior frame 22 for an air tight seal between the interior support frames 16 and the exterior frame 22. The exterior frame 22 may be of a channel or other appropriate construction. A seal wedge 24 is affixed to corners 26 of the interior support frame 16 and the window casing 14 for an air tight seal between the interior support frame 16 and the window casing 14. Screws 28 are used to fasten the exterior frame 22 to the interior support frames 16. The seal 20 and the seal wedge 24 may be of suitable insulating material, such as polystyrene, or other water resistant material, commonly used for sealing and insulating purposes.

Figure 6:
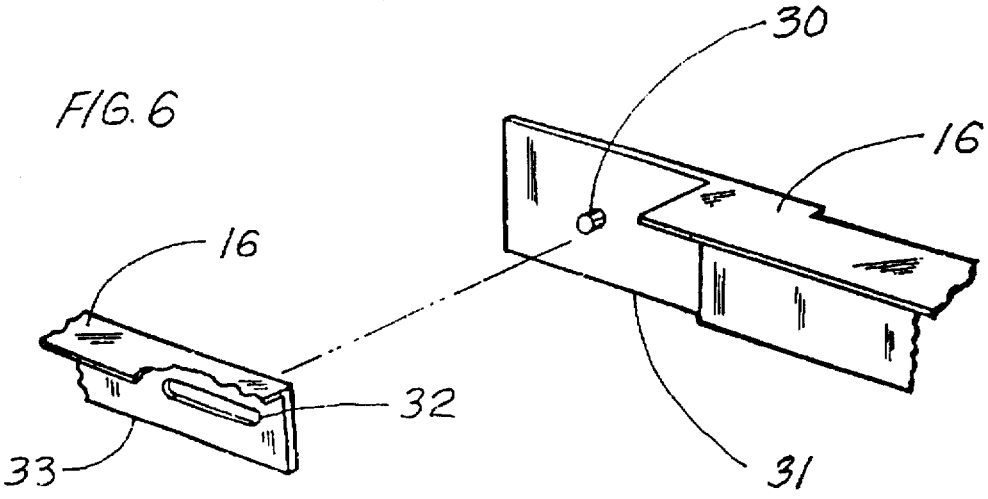
FIG. 6 is a perspective view of mating interior support frames of the window draft shield.

The mating interior support frames 16 are shown in FIG. 6, each of the interior support frames 16 having peg 30 at one end 31 and slot 32 at an opposite end 33. The peg 30 inserts into the slot 32, which allows for size adjustment of the assembled mating interior support frames 16 within a range determined by the length of the slot 32, and hence allows the window draft shield 10 to fit a variety of irregular shapes and sizes of the window casings 14. A portion of the peg end 31 of the interior support frame 16 is recessed so that the peg end 31 aligns with the slot end 33 of the mating interior support frame 16.

Figure 7:
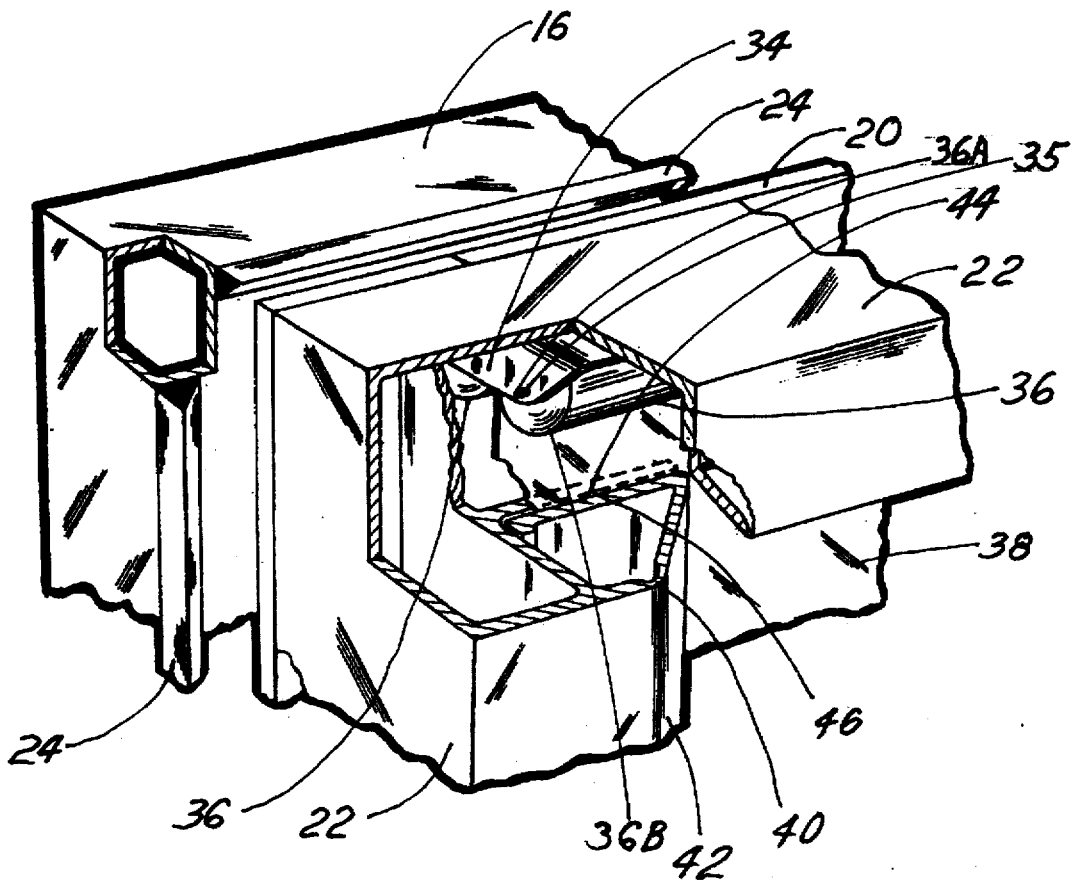
FIG. 7 is a partial cut out perspective view of a top corner section of the exterior frame of the window draft shield.

FIG. 7 shows a roller support 34 having pin supports 35 adjoined to the top of the exterior frame 22 having at least one roller 36. The rollers 36 have depressable spring loaded pins 36A at opposing ends 36B of the rollers 36, which are mounted in the pin supports 35 for supporting the rollers 36. Flexible windows 38 of suitable flexible material are respectively rolled up, collected, and retracted for storage and mounted on each of the respective rollers 36. Each of the flexible windows 38 is dispensed from the respective rollers 36, so that the flexible windows 38 are unrolled partially from each of the respective rollers 36 or fully extended to the complete vertical length of the window draft shield 10 to minimize and prevent drafts. The rollers 36 may be spring loaded internally, so that the rollers 36 are rotationally spring loaded with respect to the depressable spring loaded pins 36A, and self locking in place with the depressable spring loaded pins 36A being keyed to the pin supports 35, as in a window shade, so as to allow for each of the flexible windows 38 to be unrolled partially from each of the respective rollers 36 or fully extended to the complete vertical length of the window draft shield 10 and locked into place. The flexible windows 38 are of clear transparent material, tinted, colored transparent, ultra violet filter, translucent, opaque, or patterned material to allow a user personal choice for use and appearance, while minimizing and preventing drafts. The flexible windows 38 may also be of a screen material for preventing insects from entering the building, when the window 12 is partially or full opened. The respective flexible windows 38 may be interchanged with the other respective flexible windows 38 of the window draft shield 10, removed for maintenance or cleaning, and replaced easily by depressing the depressable spring loaded pins 36A during removal and reinstallation.

The flexible windows 38 are locked into place in a partially or fully extended position, using a self locking self hinge 40, which may be integrally constructed as part of the exterior frame 22, to pivot a moveable locking clamp 42 to lock the flexible window 38 into place between opposing surfaces 44 and 46, thereby creating a seal between the flexible windows 38 and the exterior frame 22. The locking clamp 42 is opened, as shown at position 48 when the flexible window 38 is being raised or lowered into position and also be left in a locked or open position when the flexible window 38 is retracted onto the roller 36 for storage. More than one of the flexible windows 38 may be locked into place by the locking clamp 42 at any one time.

The interior support frames 16 and the exterior frame 22 of the window draft shield 10 the may be of aluminum, steel, PVC, or other suitable material. A suitable flexible material, such as fatigue resistant PVC is preferred for the self locking self hinge 40. However, a standard hinge with a pin of aluminum, steel, PVC, or other suitable material may also be used, in lieu of the self locking self hinge 40. The window draft shield 10 may be installed inside or outside the window 12.

Although the present invention has been described in considerable detail with reference to certain preferred versions thereof, other versions are possible. Therefore, the spirit and scope of the appended claims should not be limited to the description of the preferred versions contained herein.

What is claimed is:

1. A window draft shield, comprising:

at least one flexible window for preventing draft from infiltrating into a building;

at least one roller, each said roller having at least one each said flexible window mounted thereon and dispensing and retracting each said respective flexible window;

an exterior frame supporting said rollers, said exterior frame having a plurality of locking clamps locking said flexible windows into place and creating a seal between said flexible windows and said exterior frame when said flexible windows are dispensed; and a plurality of mating interior support frames adjoined to said exterior frame and adjoining said window draft shield to a window casing.

2. The window draft shield according to claim 1, wherein each said locking clamp further comprises a plurality of opposing surfaces interfacing with said flexible windows and clamping said flexible windows therebetween.

3. The window draft shield according to claim 1, wherein each said locking clamp is hingedly adjoined to said exterior frame by a hinge.

4. The window draft shield according to claim 3, wherein each said hinge is a self hinge.

5. The window draft shield according to claim 1, wherein each said locking clamp is self locking.

6. The window draft shield according to claim 5, wherein each said self locking clamp is hingedly adjoined to said exterior frame by a hinge.

7. The window draft shield according to claim 6, wherein each said hinge is a self hinge.

8. The window draft shield according to claim 1, further comprising a seal sandwiched between said exterior frame and said interior support frames creating a seal between said exterior frame and said interior support frames.

9. The window draft shield according to claim 1, further comprising a seal wedge affixed to corners of said interior support frames and said window casing creating a seal between said interior support frames and said window casing.

10. The window draft shield according to claim 1, wherein said flexible window is of a transparent material.

11. The window draft shield according to claim 1, wherein said flexible window is of a translucent material.

12. The window draft shield according to claim 1, wherein said flexible window is of a tinted material.

13. The window draft shield according to claim 1, wherein said flexible window is of a colored transparent material.

14. The window draft shield according to claim 1, wherein said flexible window is of an ultra violet filter material.

15. The window draft shield according to claim 1, wherein said flexible window is of an opaque material.

16. The window draft shield according to claim 1, wherein said flexible window is of a patterned material.

17. The window draft shield according to claim 1, wherein said flexible window is of a screened material.

18. The window draft shield according to claim 1, wherein said flexible window is of a reflective material.

19. The window draft shield according to claim 1, wherein said mating interior support frames are adjustable so as to allow said window draft shield to fit a variety of irregular sizes and shapes of said window casings.

20. The window draft shield according to claim 19, wherein each said adjustable mating interior support frame has a peg and a slot at opposite ends of each said mating interior support frame, such that said peg from one said mating interior support frame aligns with said slot from another said mating interior support frame.

21. The window draft shield according to claim 1, wherein said window casing is interior to said building.

22. The window draft shield according to claim 1, wherein said window casing is exterior to said building.

23. The window draft shield according to claim 1, wherein each said flexible window is removable from and reinstallable onto said window draft shield.

24. The window draft shield according to claim 1, wherein each said roller has means for selectively dispensing and retracting each said respective flexible window to selected lengths.

* * * * *